United States Patent [19]

Vosper

[11] Patent Number: 4,628,832

[45] Date of Patent: Dec. 16, 1986

[54] DUAL FUEL PILOT BURNER FOR A FURNACE

[75] Inventor: Ralph R. Vosper, Somerset, Calif.

[73] Assignee: Coen Company, Inc., Burlingame, Calif.

[21] Appl. No.: 823,714

[22] Filed: Jan. 29, 1986

[51] Int. Cl.[4] ..... F23C 1/10

[52] U.S. Cl. ..... 110/261; 110/264; 110/265; 431/187; 431/284

[58] Field of Search ..... 110/260–265, 110/301–302, 309–310, 313, 104 R, 104 B, 215; 431/185, 187, 264, 284

[56] References Cited

U.S. PATENT DOCUMENTS

| | | | |
|---|---|---|---|
| 3,074,361 | 1/1963 | Huge et al. | 110/104 R |
| 3,115,851 | 12/1963 | Ceely | 110/261 X |
| 3,256,842 | 6/1966 | Vigneron et al. | 431/284 |
| 4,147,116 | 4/1979 | Graybill | 110/264 X |
| 4,157,889 | 6/1979 | Bonnel | 110/263 X |
| 4,279,206 | 7/1981 | Pitts et al. | 110/215 X |
| 4,428,309 | 1/1984 | Chang | 110/265 X |
| 4,457,695 | 7/1984 | Kummel | 110/264 X |
| 4,474,120 | 10/1984 | Adrian et al. | 110/261 |

*Primary Examiner*—Albert J. Makay
*Assistant Examiner*—Steven E. Warner
*Attorney, Agent, or Firm*—Townsend and Townsend

[57] ABSTRACT

A dual fuel burner for a furnace having a tubular housing with upstream and downstream ends and a coaxially disposed ignition chamber terminating in a discharge opening at the downstream end of the housing. A high volatility fuel is ignited within the ignition chamber and the resulting flame passes through the discharge opening. A plurality of pulverized solid fuel conduits surround the ignition chamber and extend from the upstream end to the downstream end of the housing where they discharge the fuel in close proximity to the discharge opening of the ignition chamber. An air intake supplies air to the downstream end of the housing, and a bulkhead is disposed between the air intake and the upstream end of the housing preventing air from flowing towards the upstream end. The air flowing through the downstream end flows out of the housing in a generally annular pattern between the flame issuing from the discharge opening and the solid fuel discharged from the conduits.

8 Claims, 3 Drawing Figures

DUAL FUEL PILOT BURNER FOR A FURNACE

BACKGROUND OF THE INVENTION

The present invention relates generally to a pilot burner capable of using a small stream of fuel to ignite a much larger stream of the same or another fuel, e.g. a stream of pulverized coal.

The increasingly serious fuel shortage, especially a shortage of inexpensive gas and fuel oils, has prompted several industries, including utility companies and cement companies, to convert from using fuel oil in pilot burners to using pulverized solid fuel such as coal. Existing oil pilot systems in coal-fired facilities require an expensive additional second oil fuel system in order to supply the fuel oil to the pilot burner. Therefore, it would be desirable to devise a pulverized solid fuel pilot burner which is fueled by a minimum amount of liquid fuel while maintaining adequate combustion of solid fuel.

This invention advantageously supplies a pilot burner which operates using a combination of liquid fuel and pulverized fuel. The burner uses a minimum amount of liquid fuel to ignite a much larger stream of coal and is particularly useful for igniting main furnace burners in a coal-fired facility. By using a minimum amount of liquid fuel for the pilot light, continuous fuel savings are realized throughout the lifetime operation of the facility.

SUMMARY OF THE INVENTION

A preferred embodiment of the present invention is constructed of an elongated tubular burner housing. A bulkhead about midway between the ends of the housing defines an upstream section and an air tight downstream section in fluid communication with a relatively large air inlet. At its upstream end the housing is closed off by a fuel intake head and its downstream end terminates in a nozzle. An ignition chamber is coaxially disposed within the burner housing and terminates in a flame discharge opening in the nozzle. A plurality of pulverized solid fuel carrying pipes surrounding the ignition chamber extend from the upstream end to the downstream end of the housing and terminate at fuel ejection ports in the nozzle. An atomizer within the burner housing atomizes liquid fuel and flows the atomized fuel into the ignition chamber wherein it is ignited by a high voltage electrical spark. The resulting flame issues from the flame discharge opening of the nozzle and impinges upon the pulverized fuel discharged from the fuel ejection ports causing ignition of substantially all pulverized fuel discharged from the conduits. Air flowing through the air inlet and the downstream section of the housing passes over the ignition chamber to cool it and is discharged through an annular passage in the nozzle between the flame discharge opening and the fuel ejection ports to heat the pulverized solid fuel to a temperature near its ignition point to facilitate ignition of the solid fuel by the flame issuing from the flame discharge opening.

DETAILED DESCRIPTION OF THE PREFERRED EMBODIMENT

Figure 1:
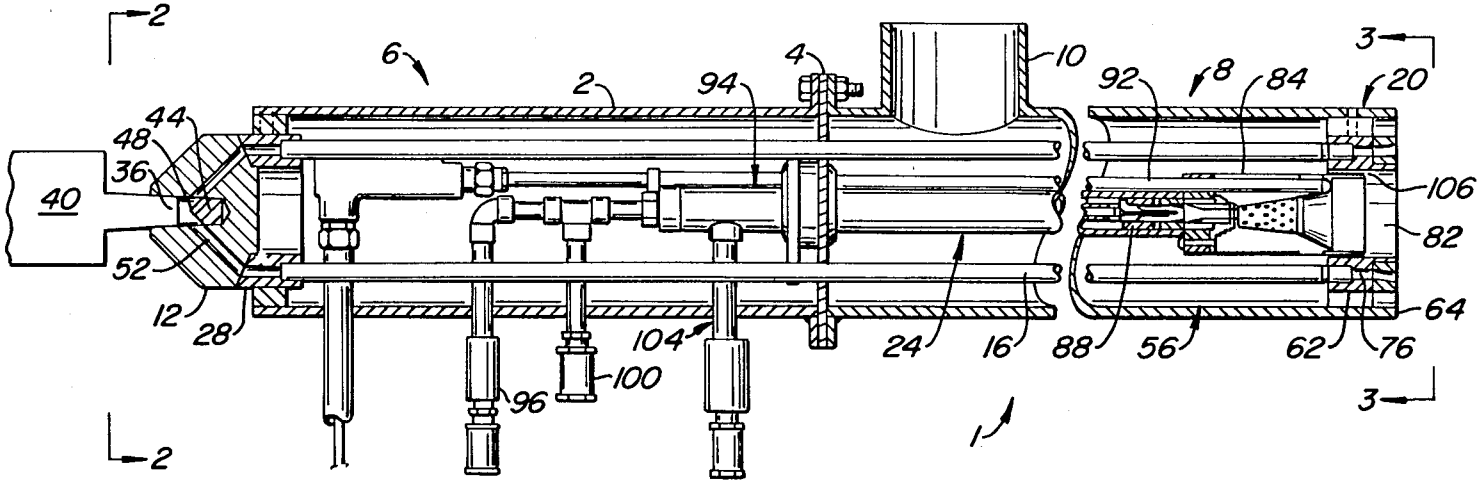
FIG. 1 is a side cross-sectional view illustrating a preferred embodiment of the invention.

Referring to FIG. 1, a pilot burner 1 includes an elongated tubular housing 2. A bulkhead 4 disposed about midway between the ends of the housing 2 defines an upstream section 6 and an air tight downstream section 8 in fluid communication with a relatively large air inlet 10. Coupled to the upstream section 6 of housing 2 is a head 12 used for introducing pulverized coal into the system. The coal passes from head 12 through a plurality of, e.g. six coal pipes 16 located proximate housing 2 and extending along the longitudinal axis of housing 2 to a nozzle 20 coupled to the downstream section 8 of housing 2. Disposed within burner housing 2 is an inner pilot 24 which extends along housing 2 and terminates at nozzle 20.

Figure 2:
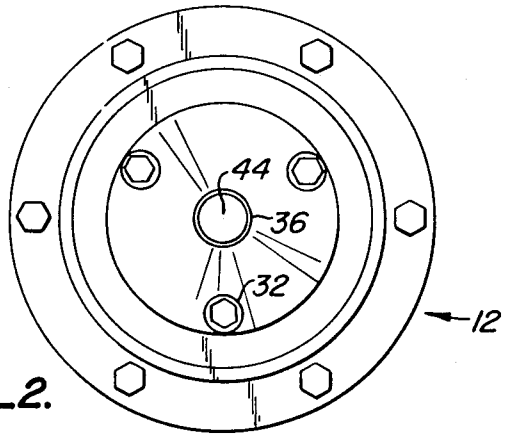
FIG. 2 is a frontal upstream view of the invention taken along line 2—2 of FIG. 1.

As shown in FIGS. 1 and 2, pilot burner 1, which is a dual-fuel pilot burner, is provided at upstream section 6 with head 12, preferably of circular cross-section. Head 12 is firmly attached to a socket 28, coupled to housing 2, by means of bolts 32. Socket 28 also preferably has a circular geometry.

Head 12 has a fuel intake 36 which receives pulverized coal entrained in an air stream from a fuel supply 40. Fuel intake 36 only partially penetrates head 12 and terminates at a conically shaped splitter 44 including a tip 48 facing outwardly (to the left) of head 12, and which is disposed concentrically within fuel intake 36.

At least one fuel intake conduit 52 opens into fuel intake 36 in close proximity to the splitter 44 for receiving at least a portion of the coal entering through fuel intake 36. In the presently preferred embodiment, six circumferentially spaced fuel intake conduits 52 are formed in head 12 and each communicates with a forwardly extending coal pipe 16.

Figure 3:
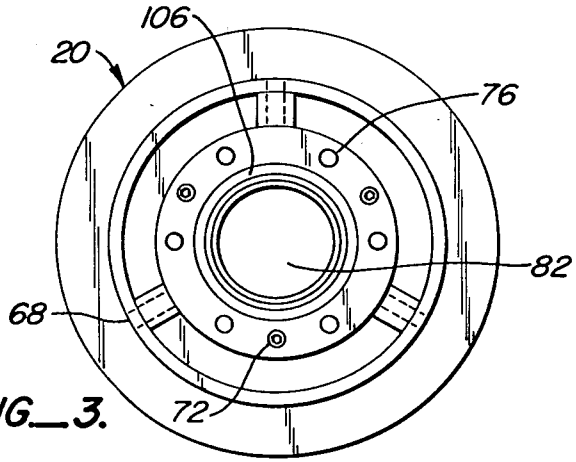
FIG. 3 is a frontal downstream view of the invention taken along line 3—3 of FIG. 1.

As shown in FIGS. 1 and 3, nozzle 20 is mounted on the downstream section 8 of housing 2. Nozzle assembly 20 comprises an inner ring 62, coupled to housing 2, and an end cap 64 adjacent inner ring 62 which securely holds inner ring 62 in its proper position and protects it against damage. Inner ring 62 is held in place by set screws 68, and end cap 64 is held in place by cap screws 72.

Located radially within inner ring 62 and end cap 64 are pulverized fuel ejection ports 76 which communicate with coal pipes 16. Centered within inner ring 62 and end cap 64 is a flame discharge opening 82.

The shape of the coal flame can be adjusted to some extent by the replaceable end cap 64. The angle of ejection ports 76 in end cap 64 may range from straight ahead, to slightly converging, or to diverging widely so as to produce a bushy flame. FIG. 3 shows round ejection ports 76 in end cap 64, but these could be replaced with milled slots so that each ejection port 76 can act as a splaying surface to produce a thin sheet of coal spray.

Located within housing 8 is inner pilot 24 for igniting the coal as it exits fuel ejection ports 76. Referring to FIG. 1, inner pilot 24 includes a hood 84, an atomizer 88 (which, in the preferred embodiment, is constructed according to U.S. Pat. No. 3,739,989 issued June 19, 1973 to Vosper and owned by the present assignee), an electrode 92, and an inner pilot tube assembly 94 comprising a liquid fuel inlet tube 96 and a purge air tube 100 for flowing air through liquid fuel inlet tube 96 when purging the system, and an atomizer air tube 104.

Inner pilot 24 extends through bulkhead 4, which sealingly supports it within housing 2, and terminates at nozzle 20. At least a portion of hood 84 is concentrically disposed within and radially spaced from the flame discharge openings 82 in nozzle 20 to form an annular passage 106.

In operation, air and liquid fuel flow through inner pilot tube assembly 94 to atomizer 88. The atomized air/fuel mixture flows into hood 84 wherein the mixture is ignited by a high-voltage spark emitted by electrode assembly 92. The resulting flame passes from hood assembly 84, through flame discharge opening 82, and ignites the pulverized solid fuel exiting from ejection ports 76.

Air flows into air inlet 10 and through the downstream section 8 of housing 2. No air flows through upstream section 6 because of the sealing action of bulkhead 4. The air flowing through housing 2 ultimately passes through annular passage 106 formed by the outer surface of hood 84 and the inner surface of flame discharge opening 82 in nozzle 20. As the air flows around hood 84 and through annular passage 106 to the furnace, it cools hood 84 and nozzle 20 to avoid overheating thereof. Consequently, the air heated by hood 84 flows into the furnace wherein it heats the area directly outside nozzle 20 including the coal emerging from ejection ports 76. The heated air warms the emerging coal so that less flame energy is needed to ignite the coal.

The foregoing design minimizes the quantity of oil used in the pilot. In testing it was noticed that a good coal fire could be produced with a coal flow of anywhere from 0 to approximately 850 lbs. per hour while using an oil flow rate of 2 gallons per hour. The total heat release at maximum fire was then 10.48 million Btu per hour with oil representing 2.7 percent of the total. Since the oil flow rate can be adjusted from 1.8 GPH to 10.8 GPH, this design permits using a minimum amount of oil for a given situation. After initial warm up of a "hot" refractory furnace and using coal with a respectable volatile content, the oil flow could be reduced to a minimum or possibly to zero. On the other hand, if the coal were a high ash, low volatile type and the burner was being fired in a "cold" environment, the oil flow would be adjusted for a higher rate.

While the above is a complete description of a preferred embodiment of the present invention, various modifications may be employed as a matter of design choice. For example, the number of coal conduits may be increased or decreased as desired, and nozzle 20 could be made of one piece.

Consequently, the description should not be used to limit the scope of the invention which is properly set out in the claims.

What is claimed is:

1. A dual fuel burner for a furnace adapted to use pulverized, solid fuel having a relatively low volatility as the primary fuel, the burner comprising:

an elongated, tubular housing having upstream and downstream ends and a generally coaxially disposed ignition chamber terminating in a discharge opening at the downstram end of the housing;

a plurality of pulverized solid fuel carrying conduits surrounding the chamber, extending from the upstream end to the downstream end of the housing and terminating at conduit outlets surrounding the discharge opening for flowing the pulverized solid fuel through the conduits and discharging it into the furnace in close proximity to the discharge opening of the chamber;

means for directing a relatively high volatility fuel into the chamber;

means for igniting the high volatility fuel in the chamber so that a pilot flame issues through the discharge opening into the furnace;

first combustion air inlet means in fluid communication with the ignition chamber providing air for sustaining the pilot flame; and second combustion air inlet means communicating with the downstream end of the housing providing at least a portion of the air required for the combustion of the pulverized solid fuel in the furnace;

a generally annular nozzle at the downstream end of the housing and including a central aperture defining the discharge opening and a plurality of pulverized fuel ejection ports in fluid communication with the conduit outlets for the discharge of the pulverized fuel therefrom into the furnace, whereby pulverized solid fuel from the conduit outlets surrounds the flame generated in the ignition chamber, is ignited thereby and is combusted with air from the second air inlet means;

wherein at least a portion of the ignition chamber is concentrically disposed within and radially spaced from the central aperture of the nozzle, and wherein the second air inlet means is adapted to flow air through a space between the central aperture of the nozzle and the ignition chamber so that at least a portion of the air flow cools the ignition chamber to prevent an overheating thereof while raising the temperature of the air flow to facilitate the ignition of the pulverized solid fuel in the furnace.

2. A dual fuel burner according to claim 1 wherein the second air inlet means includes an air intake opening extending through the tubular housing at a location spaced from the ends thereof, and including bulkhead means disposed between the air intake and the upstream end of the housing preventing air from flowing towards the upstream end.

3. A dual fuel burner according to claim 1 including means forming a flow of air from the second inlet means in a generally annular pattern between the pilot flame and pulverized fuel discharged from the conduit outlets.

4. The dual fuel burner according to claim 1 further including a splitter coupled to the upstream end of the housing and adapted to receive and direct substantially equal volumes of the pulverized solid fuel into each conduit.

5. The dual fuel burner according to claim 1, wherein the plurality of conduits are comprised of conduits which are radially spaced at equal distances apart from adjacent conduits and substantially parallel to one another.

6. The pilot burner according to claim 5 wherein the nozzle comprises:

a generally annular inner ring coupled to the downstream end of the burner housing, the inner ring including a central aperture and a plurality of pulverized fuel ejection ports in fluid communication with the conduit outlets, wherein at least a portion of the ignition chamber is concentrically disposed within and radially spaced from the central aperture of the inner ring; and a generally annular end cap coupled to the inner ring and including a central aperture in fluid communication with the central aperture of the inner ring and defining the discharge opening, and a plurality of pulverized solid fuel ejection ports in fluid communication with the ejection ports in the inner ring for the discharge of the pulverized fuel therefrom into the furnace.

7. The dual fuel burner according to claim 6 wherein the end cap fuel ejection ports are angled to effect a prescribed shape of coal spray.

8. The dual fuel burner according to claim 6 wherein the end cap fuel ejection ports are milled slots adapted to effect a thin sheet of coal spray emerging therefrom.

* * * * *